United States Patent [19]

Vanderklaauw

[11] 4,206,162

[45] Jun. 3, 1980

[54] METHOD FOR CONSTRUCTING CONCRETE ENCLOSURES BY COMBINATION OF LIFTPLATE-SLIPFORM METHOD

[76] Inventor: Peter M. Vanderklaauw, 7020 SW. 71 Ave., Miami, Fla. 33143

[21] Appl. No.: 948,168

[22] Filed: Oct. 3, 1978

[51] Int. Cl.[2] ..... E04B 1/35

[52] U.S. Cl. ..... 264/33; 52/745; 264/34

[58] Field of Search ..... 264/33, 34; 52/745

[56] References Cited

U.S. PATENT DOCUMENTS

| | | | |
|---|---|---|---|
| 1,066,436 | 7/1913 | Peltzer | 264/34 X |
| 3,355,853 | 12/1967 | Wallace | 264/33 X |
| 3,497,579 | 2/1970 | Barron | 264/33 |

OTHER PUBLICATIONS

Journal of the American Concrete Institute, Sept. 1952, pp. 40–44.

*Primary Examiner*—Thomas P. Pavelko
*Attorney, Agent, or Firm*—Harold L. Stowell

[57] ABSTRACT

A method for constructing concrete enclosures by means of casting two or three or more concrete plates one on top of the other, raising them o permanent or temporary structural posts and using the lifting motion of the plates to pour concrete in bottomless sideforms thus forming the walls.

1 Claim, 20 Drawing Figures

METHOD FOR CONSTRUCTING CONCRETE ENCLOSURES BY COMBINATION OF LIFTPLATE-SLIPFORM METHOD

BACKGROUND OF INVENTION

1. Field of Invention

This invention relates to a method of constructing concrete structures in which special apparatus is used to raise concrete plates cast one on top of the other at ground level, thus forming roof and floors and utilizing the lifting motion to form concrete walls.

2. Description of Prior Art

A method, generally known as "Liftslab" has been around in the building industry for many years. The method is well known. Equally well known in the building industry is a method called "Slipform." The Liftslab method has been employed in highrise apartments, office buildings, parking garages and other multi-floor structures. The Liftslab method is usually combined with posttensioning in the concrete slabs to enable the slabs to be thinner and more flexible.

The Slipform method has been employed extensively and practically exclusively in the construction of silo's, observation towers, elevator shafts and other structures where simple high vertical walls or columns form the main structural element. In the Slipform method walls or other vertical elements are formed by casting concrete in a bottomless form that rises while the concrete is being placed. Both the Liftslab and Slipform methods have been combined with conventional methods and have been generally restricted to highrise structures.

The advantages of the above described methods are: one; that practically no formwork is needed to form the concrete, and two; that placing of concrete is simple and fast. The Liftslab method and the Slipform method have not been used to any significant extent in residential and other one- and two- story structures for reason that equipment cost has thus far not justified such use.

SUMMARY OF INVENTION

This invention has for its object to take the lifting motion of one method (Liftslab) and use it for the other method (Slipform) thus bringing down cost. A further object is to simplify the method of lifting so that lifting can be done by unskilled labor further bringing down cost. The word slab is hereafter replaced by the word plate as plate is a more appropriate term to describe a thin, flat configuration. The objects of the invention will be made more apparent from the following more detailed description and accompanying drawings.

BRIEF DESCRIPTION OF INVENTION

Figure 1:
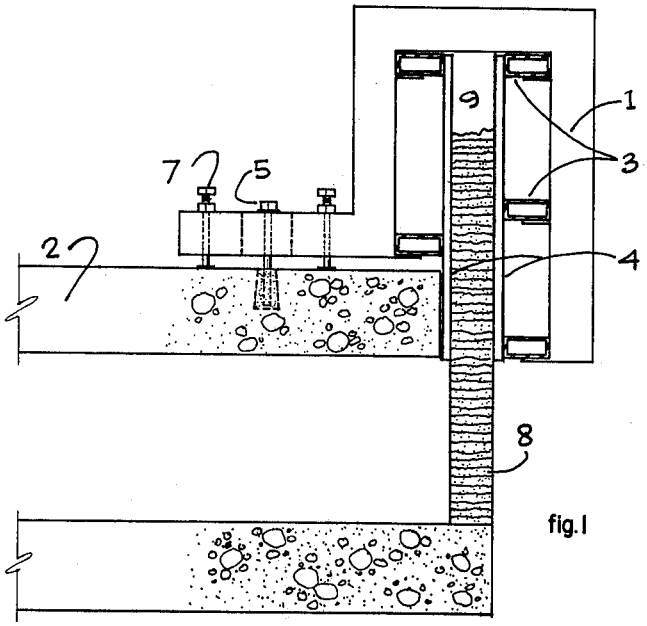
FIG. 1 is a section showing yokes attached to a concrete plate in upward motion, and inside the yokes are horizontal members which support the sides of a bottomless form.
Figure 2:
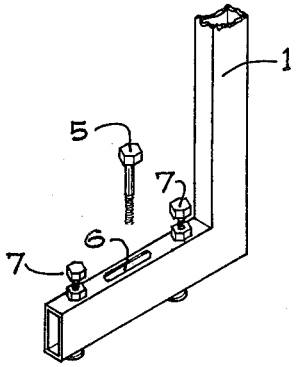
FIG. 2 shows the part of a slipform yoke that attaches to the upward moving slab.
Figure 3:
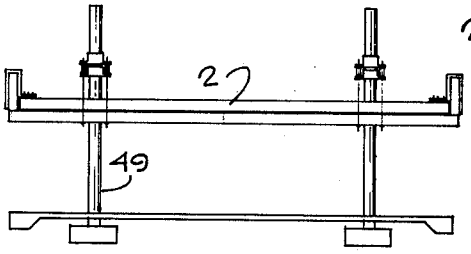
Figure 4:
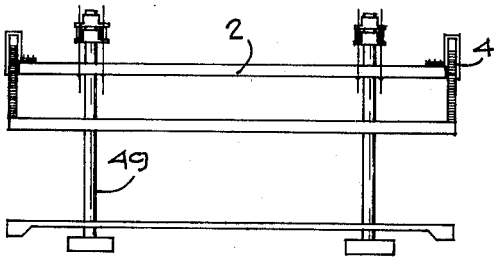
Figure 5:
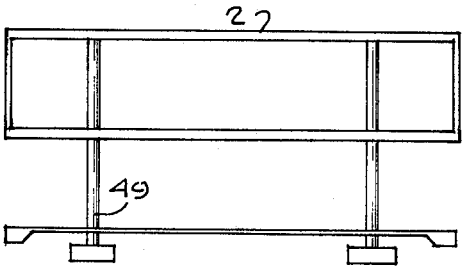

FIGS. 3 4 and 5 show three stages in which a ground slab remains at ground level and suspended plates are lifted to higher levels. FIG. 4 shows walls being "extruded". FIG. 5 shows a completed Liftplate-Slipform structure, having a typical posttension type structure in which overhangs balance the midspan equalizing stresses in the plates.

Figure 6:
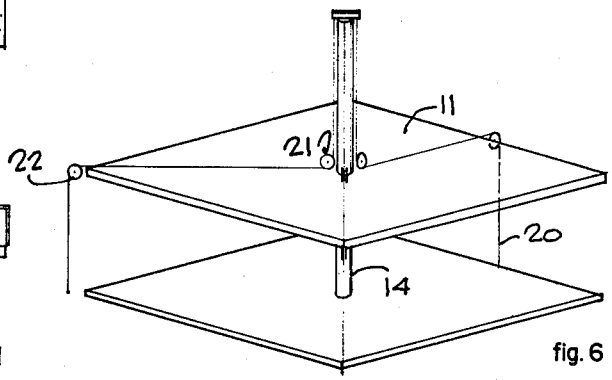

FIG. 6 is a diagram showing wires and pulleys designed to prevent a lifted plate from tipping.

Figure 7:
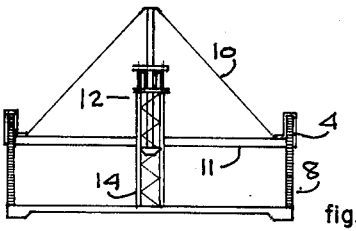

FIG. 7 shows a simple span concrete plate being lifted by a telescoping central post while the exterior walls are being "extruded".

Figure 8:
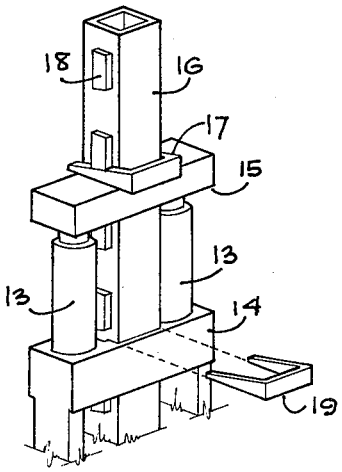
Figure 9:
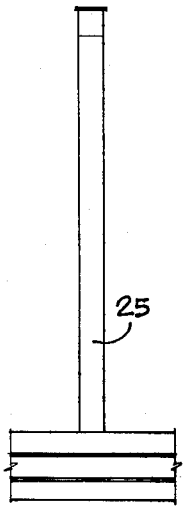

FIG. 8 is a detail of the mechanism that activates the telescoping action.

FIGS. 9 10 11 and 12 show the progression of a two-plate structure being lifted, specifically drawing attention to suspender rods holding the first plate while the second plate travels further.

Figure 13:
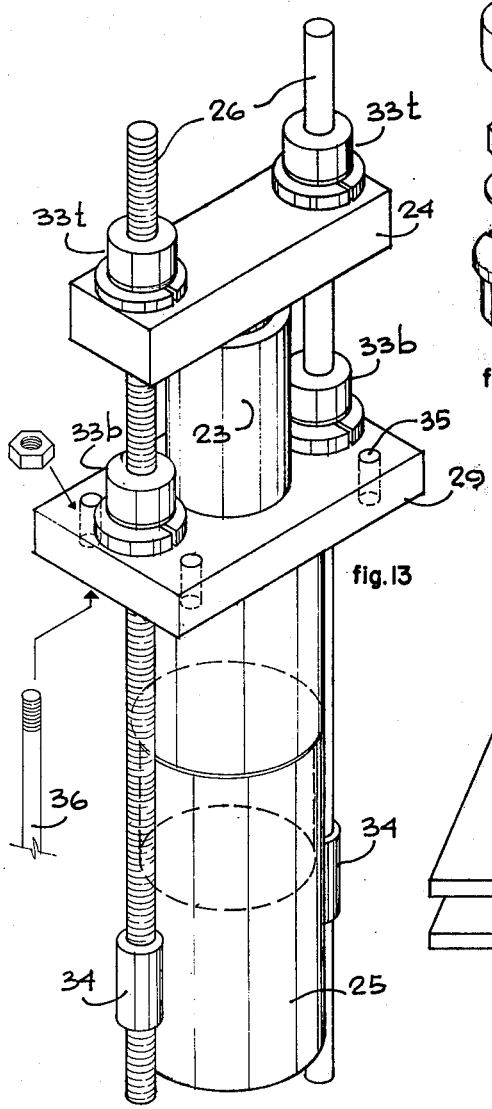

FIG. 13 shows the assembly of a lifting mechanism.

Figure 14:
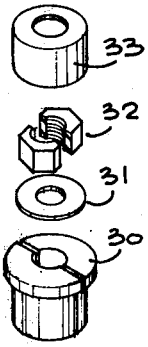

FIG. 14 is an exploded view of a split-nut-and-socket assembly belonging to the lifting mechanism shown in FIG. 13.

Figure 15:
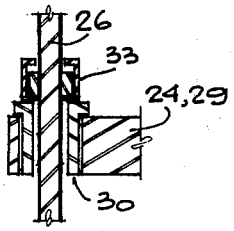

FIG. 15. shows a section through the split-nut-and-socket assembly of FIG. 14.

Figure 16:
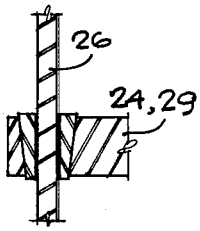

FIG. 16 shows an alternate to the split-nut-and-socket arrangement.

Figure 17:
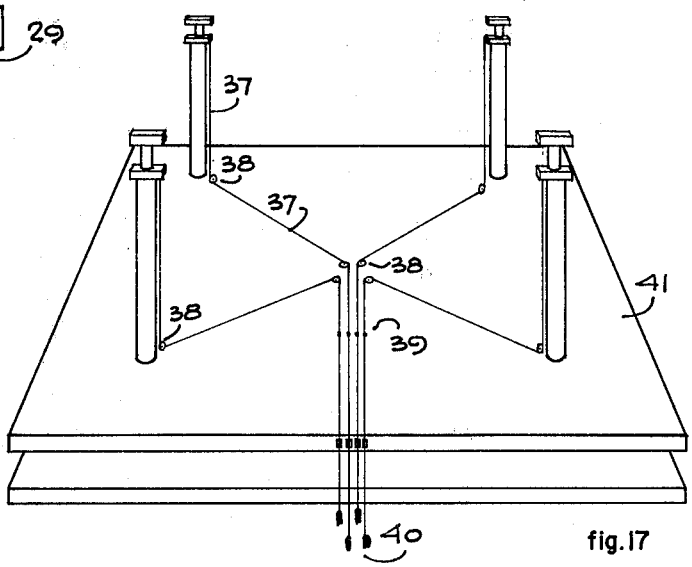

FIG. 17 is a diagram of wires and pulleys serving to ensure that a concrete plate is raised in a synchronous manner.

Figure 18:
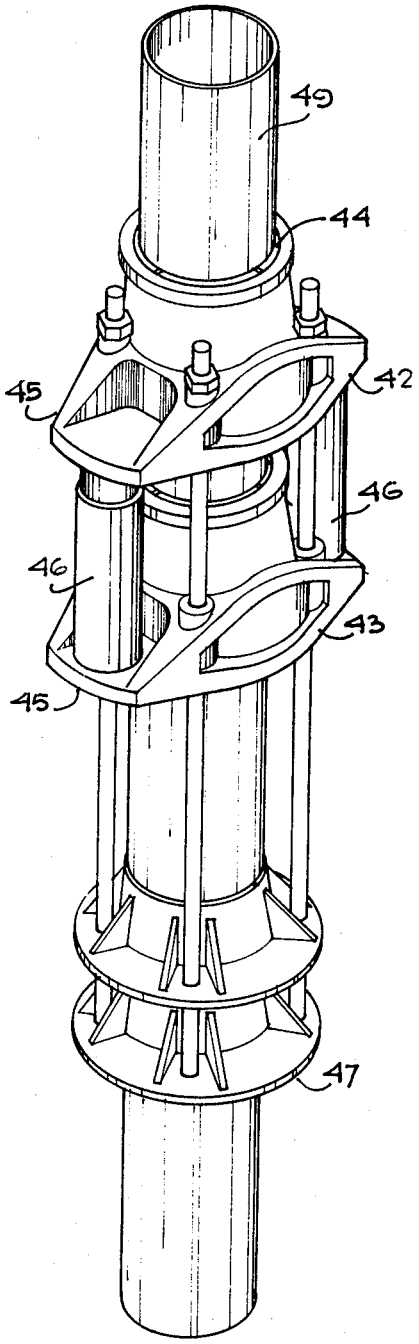

FIG. 18 shows details of a climbing mechanism that may be used to raise concrete plates as in FIGS. 3. 4. and 5.

Figure 19:
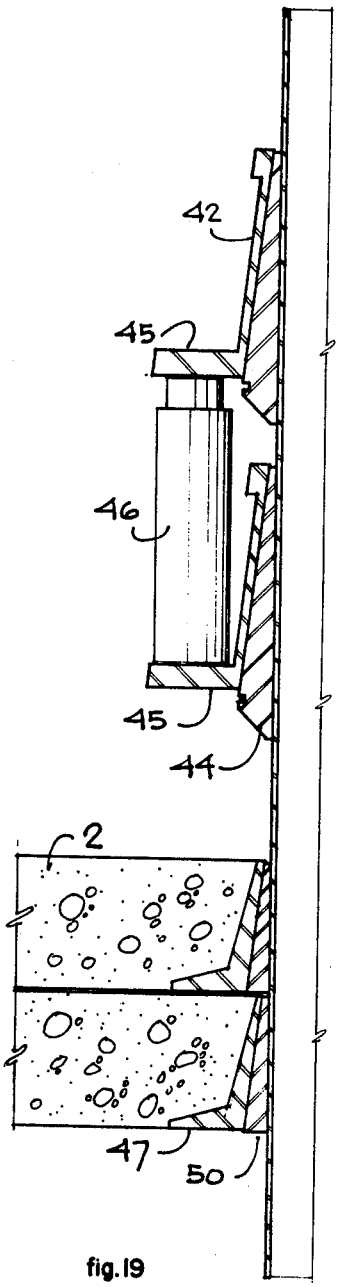
Figure 20:
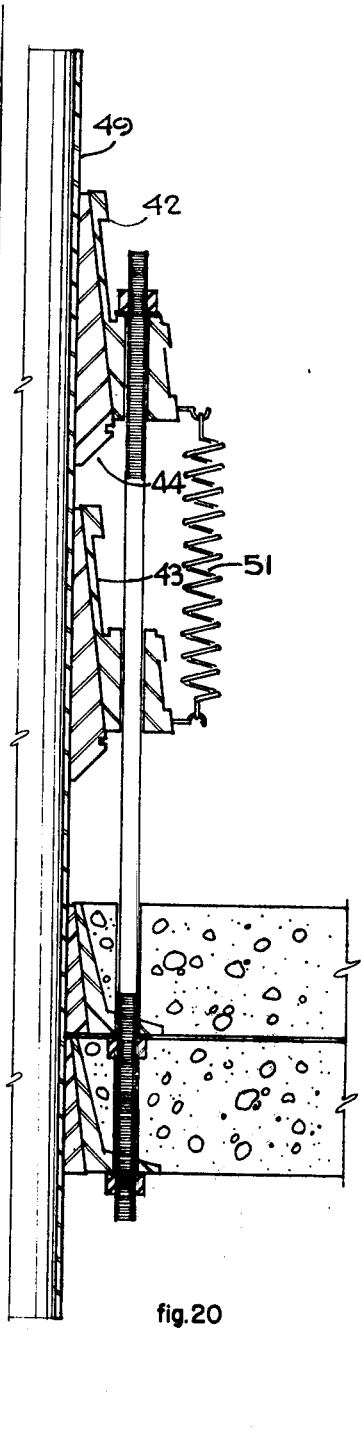

FIG. 19 and 20 are longitudinal sections through the climbing mechanism of FIG. 18.

DESCRIPTION OF PREFERRED EMBODIMENTS

Referring now to the illustrations and describing the construction method in more detail, the building process is started by casting concrete plates one on top of the other using a bond breaking compound between them. When the plate to be lifted has hardened, yokes (1) spaced 5 to 10 feet apart, are placed along the edge of the top plate (2) and stringers (3) connecting a row of yokes and in turn supporting the bottomless form (4) are installed. A typical yoke (1) is attached to the concrete plate (2) by means of a bolt (5) which passes through a slotted hole (6) in the yoke into an insert cast in the concrete plate. The yoke has two adjusting screws (7) which, combined with the slotted hole (6) enable the yoke to be adjusted horizontally, vertically and angle-wise. Wood or steel wedges may be used in lieu of adjusting screws (7). The bottomless form is best placed above the plate as shown but may in particular circumstances be located wholy or partly under the plate after the plate is partly lifted. When all yokes (1) are aligned and the stringers (3) and the bottomless forms (4) are in place and the concrete plate (2) is ready for lifting, concrete (8) is poured in the bottomless form (4). After a period of time when the concrete (8) has taken its initial set the concrete plate (2) is slowly lifted. The lifting motion results in the concrete wall (8) to be exposed at the bottom and a cavity (9) to develop at the top. As the lifting continues the wall (8) continues to be exposed and the cavity (9) is filled with new concrete. Thus a wall (8) is formed as if extruded by the bottomless form (4).

The above described wall construction is flexible as to materials and composition. The wall can be made of lightweight concrete. The exterior can have a fluted texture or a cast-in skin of metal or other durable material. Similarly the interior can have prefinished sheet material cast in by placing that material against the interior face of the bottomless form and casting the concrete against it. The prefinished material should preferably have a vapor barrier and insulating material in its composition. Furthermore the wall can be made of sandwich type by placing blocks of insulation material in the middle of the wall during casting. The advantages of this invention become apparent when one considers that the floor and the roof can be insulated by spreading a thin layer of plaster on the bond breaking compound atop the slab below and bedding into this plaster a layer of insulation material. The plaster and the insulation material become an intregal part of the roof or floor construction when lifted. Thus a completely insulated and finished structural shell can be formed by unskilled labor in the shortest possible time.

Simplification of the lifting mechanism, so it can be operated by unskilled labor, is a further object of this invention.

Three methods have been developed to accomplish this goal, each serving specific structural conditions.

Figure 10:
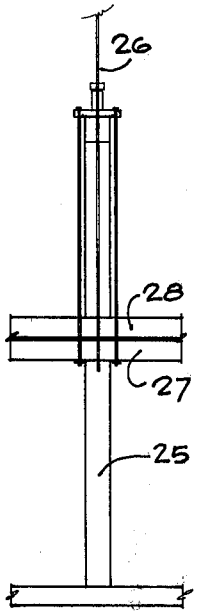

The telescoping post method shown in FIGS. 6, 7, and 8 is designed specifically for wall bearing structures. The crosshead method shown in FIGS. 13, 14, 15, 16 and 17 is designed for permanent post bearing structures and the climbing cone method shown in FIGS. 18, 19 and 10 is a universal system that can be used in low and high structures.

Now describing the telescoping-post method in more detail, this building process starts by casting concrete plate (11) on a ground slab or on soil. When that plate (11) is cured. One, two or more telescoping posts (12) are placed in openings reserved in the plate in strategic locations so as to permit rods or cables (10) pending from the top of the telescoping post (12) to attach to the edges of the plate (11). The bottomless form (4) is subsequently filled with concrete and after the concrete has its initial set the telescoping post is slowly extended while concrete is poured in the bottomless form (4). When the intended height is reached the wall (8) is poured solid with the concrete plate (11) and the telescoping post (12) removed. This action can be repeated for any number of stories.

The telescoping action is caused by two hydraulic rams (13) FIG. 8 which are placed on top of the fixed portions (14) of the telescoping post and which drives the crosshead (15) upward. Crosshead (15) attaches to the moving portion (16) of the telescoping post (12) through wedge (17) and cleats (18). When the rams (13) are activated, the moving portion (16) of the telescoping post (12) moves upward traveling the extent of the stroke of the ram. As the rams reach the end of the stroke, wedge (19) is inserted allowing crosshead (15) to return and start the next cycle. Ram actions are repeated until the desired height of the concrete plate (11) is reached.

Now referring to FIG. 6; in order to ensure that the concrete plate (11) is lifted evenly, cables (20) are attached to the top of the fixed portion of the telescoping post and, like the parallel ruler on a drawings board, the cables are laced through two pulleys (21) and (22) and attached at the other end to the ground or the structure on which the telescoping post (12) rests. Three or more cables (20) are required to ensure stability.

Now describing the crosshead method. Reference is made to Patent No. 2686420 obtained by Philip N. Youtz on Aug. 17, 1954. Youtz's patented method has suspended threaded rods pending from the top of supporting columns and attaching to a structural member or floor. Hydraulic rams in Youtz's method pull the threaded rods in a manner similar to the method described in here. My invention differs from Youtz's and other methods in the way in which the suspended rods engage the crossheads. This invention also differs in that it provides means for supporting a floor temporarily while a subsequent floor is being lifted. The action of this lifting method starts when hydraulic ram (23) FIG. 13, is activated and crosshead (24) rises in relation to column (25). Lifting rods (26) engaged to upper crosshead (24) by means of nuts **(33*t*) also rise and lift floors (27) and (28). When ram (23) reaches the end of its stroke, nuts (33*b*) are lowered by lifting socket (33) off split nut (32), placing the split nut in the lower position, reinstalling the socket (33) and turning it until the split nut seats firmly on the crosshead. When both nuts (33*b*) are thus seated on the lower crosshead (29) the hydraulic ram (23) is retracted allowing upper crosshead (24) to return. Subsequently nuts (33*t*) are moved down in the manner nuts (33*b*)** have been moved down. A new cycle can now be initiated.

The split plug (30) is designed to permit coupling (34) to pass-through the lifting assembly and can be eliminated if couplings are not used. Washer (31) serves to ensure even bearing of the nuts **(33*t* and 33*b*) on the crossheads or on the split plugs (30)**.

A further simplification of the crosshead method is shown in FIG. 16 where lifting rods (26) are engaged to crossheads (24) and (29) by means of wedges instead of the split-nut-and-socket assembly.

Prior to this invention nuts were turned down by hand or by motor. The slightest damage in threads made hand turning most difficult and often caused motors to stop. The split-nut-and-socket method eliminates those problems and speeds up work.

Figure 11:
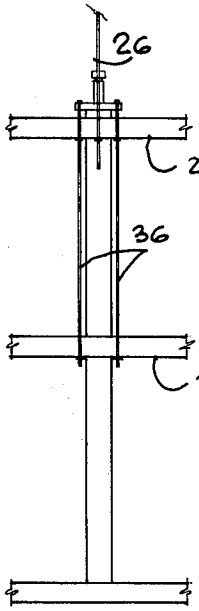
Figure 12:
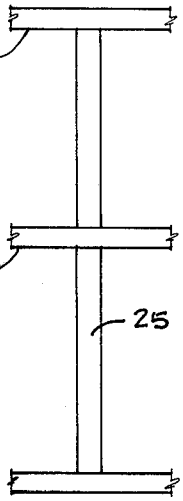

Continuing discussion of the crosshead method, bottom crosshead (29) FIG. 13 shows four holes (35). These holes (35) are used to attach temporary suspension rods (36) FIGS. 10 and 11. Temporary suspension rods (36) serve to support a floor at an intermediate level while the next floor is being lifted as shown in FIGS. 10 and 11.

Now referring to FIG. 17; since simplification of the lifting mechanism so it can be operated by unskilled labor is a further object of this invention, it is necessary to have a simple and reliable method of synchronization. The method of synchronization is shown in FIG. 17. The method has wires or steel fish lines (37) attached to the tops of columns. The wires converge through a series of pulleys (38) and have weights (40) to keep them taut. As the plate (41) rises the wires move across the floor. Markers (39) attached to each wire must move at the same rate in order to ensure synchronous lifting. An operator manipulating the valves that feed the rams on each column watches the markers, moving them at the same rate of speed.

Now describing the climbing cone mechanism shown in FIGS. 18, 19, and 20 and also shown in FIGS. 3 and 4; this climbing method is for universal use and designed for lifting structures covered herein or any other lifting condition. The climbing cone assembly comprises two cone-shaped sleeves (42) and (43) that have wedges (44) gripping on a column or any other element. The two cone sleeves also have shelves (45) between which hydraulic rams (46) are placed. To put the climbing mechanism in operation rams (46) are extended. This action presses the lower cone (43) tight against the column while it raises upper cone (42). As the rams (46) reach the end of their stroke and are retracted, the upper cone grips around the column and asserts the location it has reached. As the rams (46) are retracted, internal or external springs (51) pull the lower cone (43) toward the upper cone until the rams (46) are completely retracted and ready to start a new cycle. This action of the climbing mechanism is powerful and capable of lifting concrete plates (2) in a secure and reliable fashion. Cones may be split and halves bolted or pinned together to facilitate installation and removal at midlevel.

In commonly known liftslab methods shearheads are attached to columns by welding or by pins or bolts. This invention has shearheads (47) which have tapered inside surfaces. The attachment of these shearheads (47) to the column is through wedges (50) which grip the column. This method of attachment is positive and eliminates the need for welding or any other mechanical method thus saving time and cost.

I claim:

1. A method of constructing a concrete enclosure consisting of at least a concrete floor, a concrete roof and concrete side walls comprising the steps:

(a) casting at ground level a concrete floor;

(b) applying a bond breaking compound to the cast and hardened floor;

(c) casting at least a second concrete slab on said bond breaking compound on the cast and hardened concrete floor;

(d) attaching a plurality of yokes along the edge of the top surface of the last cast and hardened concrete slab;

(e) joining the plurality of yokes by stringer members;

(f) attaching spaced vertically extending plates to said stringer members to thereby form bottomless concrete side wall forming forms;

(g) pouring concrete between the spaced plates recited in step (f);

(h) after the concrete poured in step (g) has taken its initial set, lifting the top concrete slab to expose the poured concrete wall at the bottom of side wall forming forms and to thereby develop a cavity at the top of the forms; and (i) sequentially repeating steps (g) and (h) until the lifted slab and side walls are the desired height.

* * * * *